US011884479B2

(12) United States Patent
Crespi

(10) Patent No.: US 11,884,479 B2
(45) Date of Patent: Jan. 30, 2024

(54) PIZZA BOX AND BLANK

(71) Applicant: Jerzy Crespi, Busnago (IT)

(72) Inventor: Jerzy Crespi, Busnago (IT)

(73) Assignee: Jerzy Crespi, Monza e della Brianza (IT)

( * ) Notice: Subject to any disclaimer, the term of this patent is extended or adjusted under 35 U.S.C. 154(b) by 0 days.

(21) Appl. No.: 17/954,188

(22) Filed: Sep. 27, 2022

(65) Prior Publication Data

US 2023/0112811 A1 Apr. 13, 2023

(30) Foreign Application Priority Data

Sep. 28, 2021 (IT) ..... 102021000024749

(51) Int. Cl.
*B65D 85/36* (2006.01)
*B65D 5/20* (2006.01)
*B65D 5/54* (2006.01)

(52) U.S. Cl.
CPC ..... *B65D 85/36* (2013.01); *B65D 5/2052* (2013.01); *B65D 5/5455* (2013.01); *B65D 2585/366* (2013.01)

(58) Field of Classification Search
CPC .... B65D 85/36; B65D 5/2052; B65D 5/5455; B65D 2585/366; B65D 5/302; B65D 5/4295; B65D 5/6655; B65D 81/263; B65D 5/2038; B65D 5/3635; Y10S 229/906
USPC ..... 229/110, 902, 904, 906; 383/66; 206/509, 525; 426/128
See application file for complete search history.

(56) References Cited

U.S. PATENT DOCUMENTS

| | | | | |
|---|---|---|---|---|
| 3,163,344 | A * | 12/1964 | Tunick | B65D 5/0015 206/509 |
| 3,650,383 | A * | 3/1972 | Nigro | B65D 5/3635 229/162.1 |
| 7,578,428 | B2 * | 8/2009 | Charlton | B65D 77/0406 229/110 |
| 11,377,252 | B2 * | 7/2022 | Borst, Sr. | B65D 5/6664 |
| 11,505,361 | B2 * | 11/2022 | Trasacco | B65B 5/024 |
| 2010/0001051 | A1 | 1/2010 | Castiglioni et al. | |
| 2017/0158410 | A1 | 6/2017 | Rubino | |
| 2017/0341803 | A1 | 11/2017 | Marincola | |
| 2022/0017263 | A1 * | 1/2022 | Wikstrom | B65D 85/36 |
| 2022/0153510 | A1 * | 5/2022 | Bressan | B65D 5/6608 |

OTHER PUBLICATIONS

Search Report for IT 102021000024749 dated May 12, 2022, Munich, DE.

* cited by examiner

*Primary Examiner* — Christopher R Demeree
(74) *Attorney, Agent, or Firm* — Ferguson Case Orr Paterson

(57) ABSTRACT

A pizza box for containing a baked pizza is provided. The pizza box is suitable for assuming a box-like configuration and has a base, a lid, side walls, a front wall, a rear wall, and flaps joined to the side walls, the flaps being suitable for being removably constrained by engagement in flap coupling seats on the front wall. At least one flap has a gripping portion which, when the pizza box is in a closed configuration, extends externally, allowing a pulling force to be applied to the gripping portion to disengage the at least one flap from at least one of the flap coupling seats and to bring the pizza box into a laterally open configuration. A blank for producing a pizza box in a single piece is also provided.

13 Claims, 3 Drawing Sheets

(O)

PIZZA BOX AND BLANK

CROSS-REFERENCE TO RELATED APPLICATION

This application claims priority to Italian Patent Application No. 102021000024749 filed on Sep. 28, 2021, the contents of which are incorporated by reference in their entirety.

FIELD OF THE INVENTION

The present invention relates to a pizza box, in particular for take-out pizzas.

BACKGROUND OF THE INVENTION

Typical pizza boxes in the prior art are generally comprised of a single body, including a base, side walls, a front wall, a rear wall, and a lid.

Said boxes, typically, may take on a box-like configuration, so that the pizza may be placed on the base after it has been baked and at the same time the pizza may be accessed for eating, and a closed configuration, with the lid and side walls engaged with the front wall so that an inner compartment may be delimited and the pizza may be transported while being kept warm.

However, the known solutions have some drawbacks.

Inconveniently, once opened by lifting the lid, the pizza boxes of the prior art fail to provide a thermal seal, and, as a result, the pizza does not stay hot during the meal.

In fact, what blocks heat from escaping from the pizza box is mainly the lid, which, once lifted, no longer allows the heat to be maintained.

Inconveniently, there is also no way, other than to open the lid of the box, to take the pizza out of the box.

As a result, with known pizza boxes it is not possible to avoid lifting the lid, and thus avoid a drop in temperature, to eat the pizza contained inside.

Therefore, the need for a pizza box able to overcome the drawbacks of the prior art is strongly felt.

SUMMARY OF THE INVENTION

This need is satisfied by a pizza box as described and claimed herein. Preferred or advantageous embodiments of the present invention are also described.

BRIEF DESCRIPTION OF THE FIGURES

The features and advantages of the pizza box will become apparent from the description below of some preferred embodiments, given by way of indicative and non-limiting example, with reference to the attached figures, wherein.

DETAILED DESCRIPTION

Figure 1:
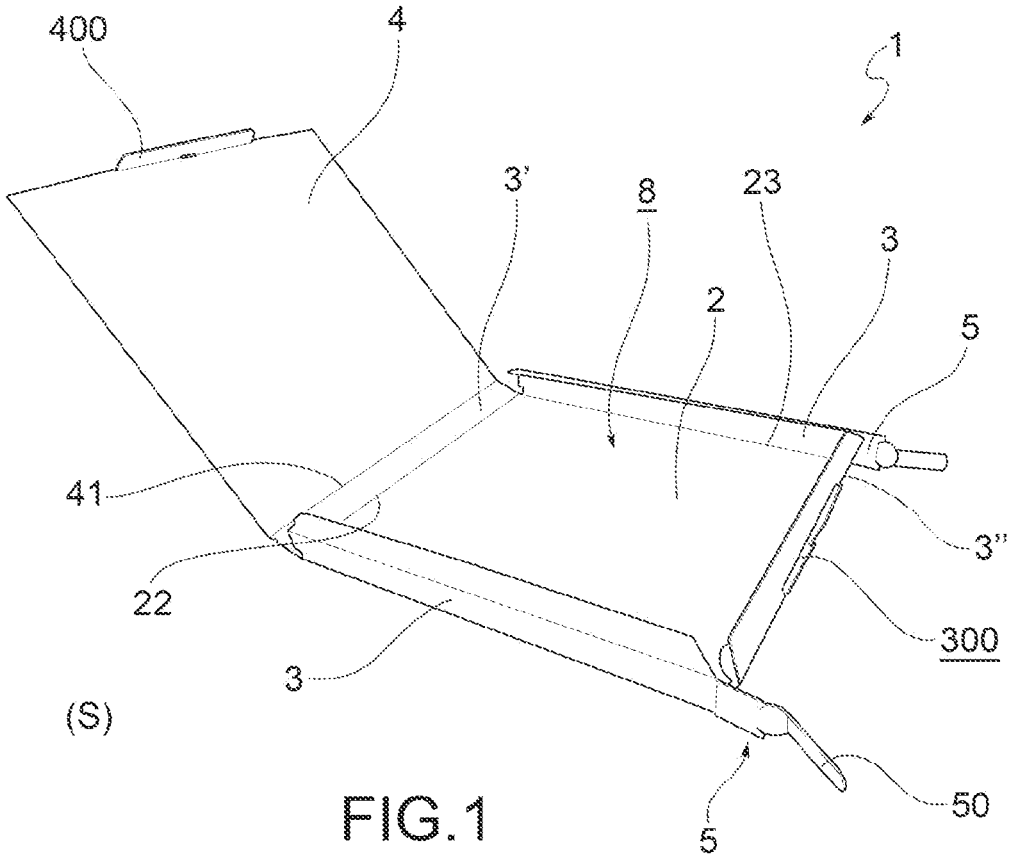
FIG. 1 is a perspective view of a pizza box 1 in a box-like configuration S.
Figure 2:
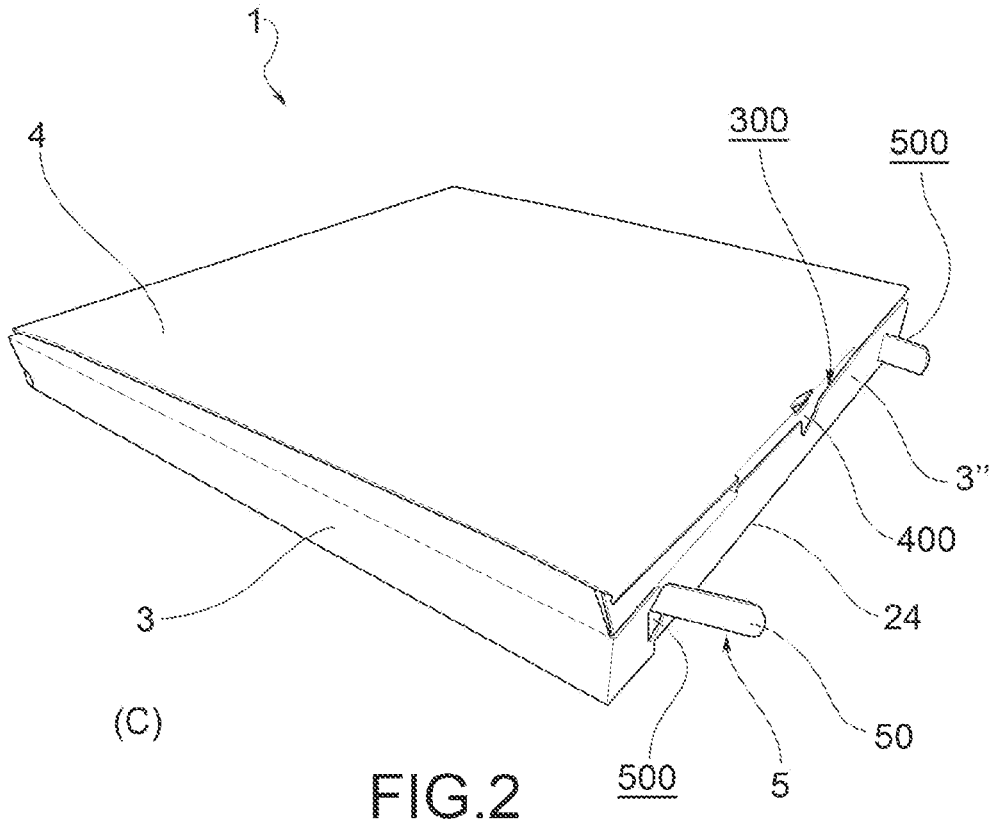
FIG. 2 is a perspective view of a pizza box 1 in a closed configuration C.
Figure 3:
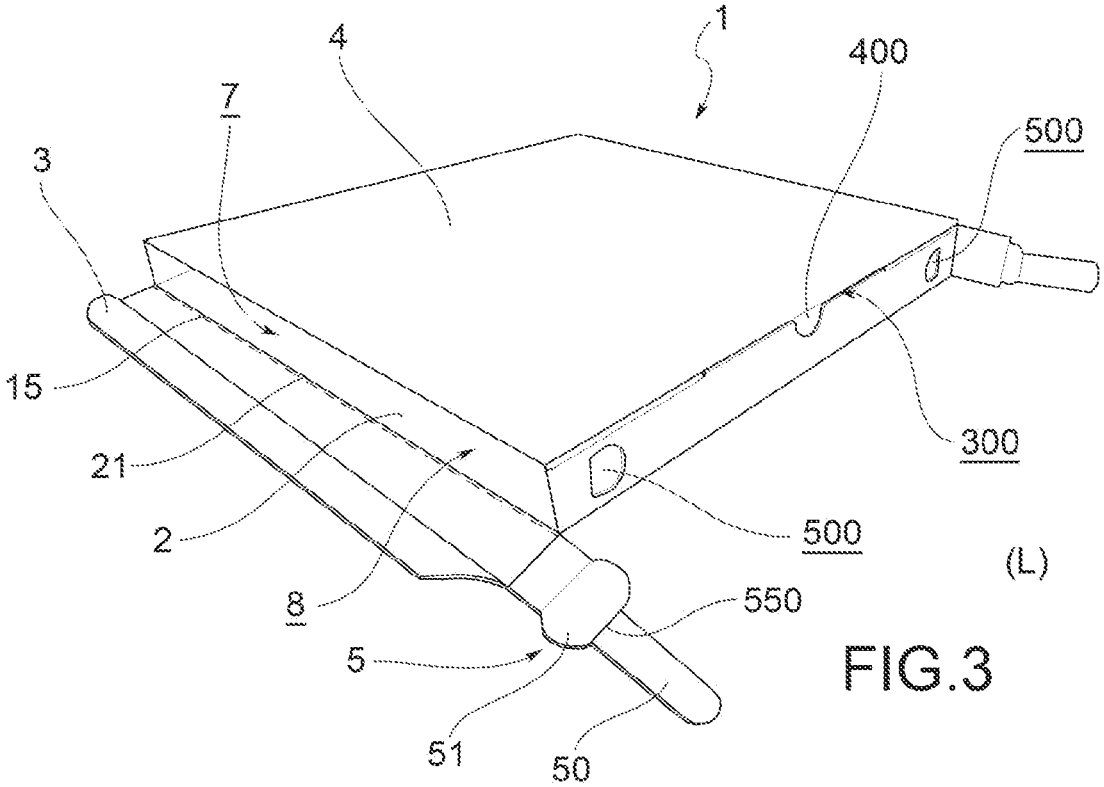
FIG. 3 is a perspective view of a pizza box 1 in a laterally open configuration L.
Figure 4A:
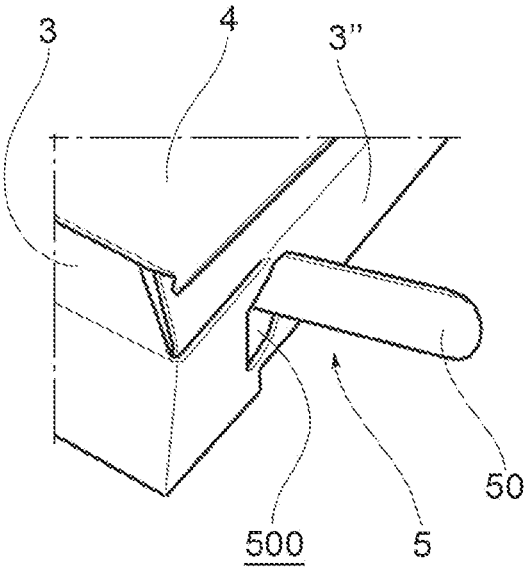
FIG. 4*a* is an enlarged view of a detail from FIG. 2.
Figure 4B:
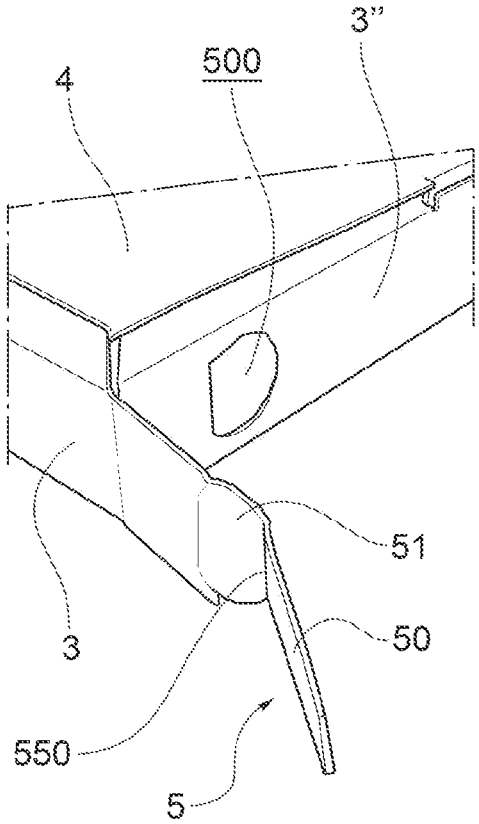
FIG. 4*b* is an enlarged view of a detail of a pizza box according to an embodiment of the present invention, in which the flap 5 is not engaged in the flap coupling seat 500.
Figure 5:
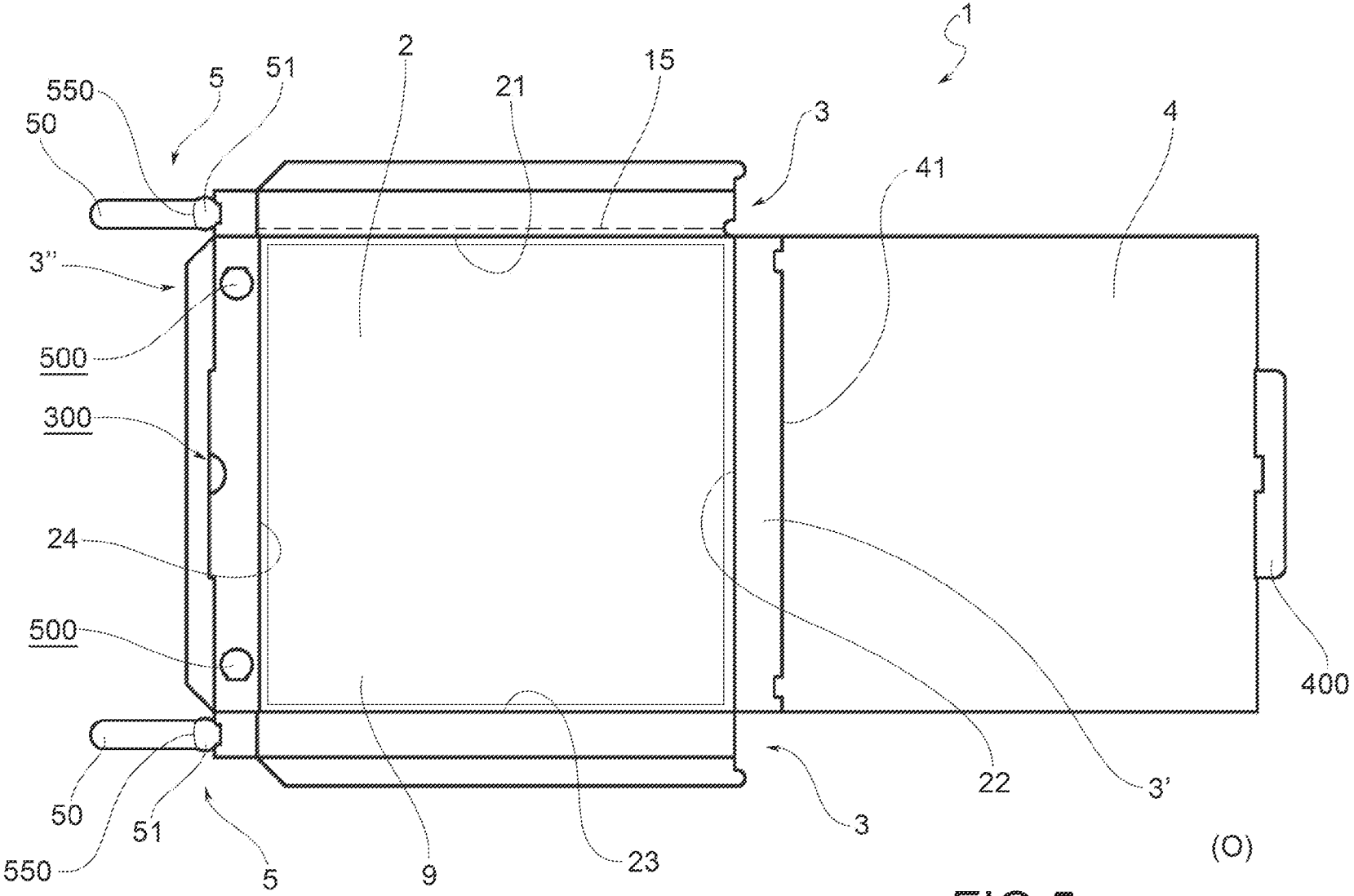
FIG. 5 is a top view of a pizza box 1 in a fully open configuration O.

With reference to the figures, a pizza box is collectively indicated with reference number 1.

The pizza box 1 is suitable for assuming a box-like configuration S in which it is suitable for easily accommodating a baked pizza.

According to the present invention, the pizza box 1 in the box-like configuration S comprises a base 2, a lid 4, side walls 3, a rear wall 3', and a front wall 3". Preferably, the pizza box 1 is made by cutting or die-cutting.

According to the present invention, the base 2 identifies a base plane and is suitable for receiving the pizza, and the lid 4 comprises a lid coupling means 400.

The side walls 3 are delimited by side edges 21, 23 in common with the base 2, and extend along planes which are incident, e.g., perpendicular, to the base plane.

The rear wall 3' comprises a rear edge 22 in common with the base 2 and a lid edge 41 in common with the lid 4, and identifies a rear plane which is incident, e.g., perpendicular, to the base plane.

The front wall 3" has a front edge 24 in common with the base 2 and defines a front plane which is incident, e.g., perpendicular, to the base plane.

In particular, the side 3, rear 3' and front 3" walls, together with the base 2 and the lid 4, define at least partially an inner compartment 8 suitable for containing the pizza.

In addition, according to the present invention, a lid coupling seat 300 suitable for engaging with the lid coupling means 400 is obtained on the front wall 3".

Furthermore, according to the present invention, flap coupling seats 500 are obtained, e.g., by means of cutting, on the front wall 3".

According to the present invention, the pizza box 1 comprises flaps 5 joined to the side walls 3. The flaps 5 are suitable for being removably engaged with the front wall 3" by engagement in the flap coupling seats 500.

According to the present invention, the pizza box 1 is suitable for assuming a closed configuration C in which the lid 4 is constrained to the base 2 by engagement between the lid coupling means 400 and the lid coupling seat 300 and in which the flaps 5 are removably engaged with the flap coupling seats 500.

The closed configuration C allows the pizza to be transported and the heat to be maintained inside the inner compartment 8.

Moreover, according to the present invention, the pizza box 1 is suitable for assuming a laterally open configuration L in which the lid 4 is constrained to the base 2 by engagement between the lid coupling means 400 and the lid coupling seat 300, and in which at least one of the flaps 5 is disengaged from at least one of the flap coupling seats 500, so that at least one of the side walls 3 is suitable for being tilted so as to generate a side opening 7 suitable for allowing access to the inner compartment 8 for extracting the pizza or a portion thereof.

The term "tilted" means the rotation about an axis passing on one of the side edges 21, 23 to the outside of the inner compartment 8.

The laterally open configuration L allows the pizza to be extracted without needing to lift the lid 4. In this way, the compartment 8 is accessible only through the space occupied by one of the side walls 3, and the decrease in temperature inside the pizza box 1 is reduced.

The flaps of the pizza boxes of the prior art are generally small in size, as they serve the mere purpose of constraining the side walls to the front wall of the pizza box.

Conversely, according to the present invention, at least one of the flaps 5 comprises a gripping portion 50 which, when the pizza box 1 is in the closed configuration C, extends outwards, i.e., on the opposite side with respect to the inner compartment 8, beyond the front wall 3", allowing the consumer to easily apply a pulling force to the gripping portion 50 for disengaging said at least one of the flaps 5 from at least one particular seat of the flap coupling seats 500 and to bring the pizza box 1 into the laterally open configuration L.

The presence of the gripping portion 50 allows the consumer to extract the whole pizza or a part of it from the side opening 7 without necessarily bringing his or her fingers close to the flap coupling seats 500; this is thus more functional and practical.

Furthermore, advantageously, the shape of the flap 5 speeds up engagement and disengagement operations between the flap 5 and the flap coupling seat 500, so that they may be repeated several times during the meal to repeatedly extract and reinsert the pizza or pizza slices inside the inner compartment 8.

This would not be possible with the flaps of the prior art, which do not comprise a gripping portion and extend, in a closed configuration, internally into the inner compartment, serving the sole object of constraining the side walls with the front wall. Extraction of the flaps of the prior art is therefore not possible in a closed configuration, much less repeatable many times in a short time such as that of a meal.

Preferably, the pizza box 1 is suitable for assuming a fully open configuration O (blank) in which the base 2, the side walls 3, the rear wall 3', the front wall 3", the lid 4, and the flaps 5 are all lying substantially along the same plane, e.g., the base plane.

Preferably, the pizza box 1 is made in a single piece by cutting and/or die-cutting.

Preferably, the pizza box 1 is made of corrugated cardboard.

According to a preferred embodiment of the present invention, the gripping portion 50 is also a corrugated cardboard tab, preferably made in a single piece with the flap 5. Said solution is particularly advantageous in that it allows easy industrialization of the product, involving limited changes to the shape of the die-cutting templates (dies) already used for the production of the pizza boxes of the prior art.

Preferably, the flap 5 comprises a proximal portion 51 having an enlarged section, and the gripping portion 50 has a narrow section, so that the proximal portion 51 makes the flap 5 engageable with the flap coupling seat 500 by interference, and the gripping portion 50 is free to move into the flap coupling seat 500. According to an embodiment, the gripping portion 50 is joined to the proximal portion 51 in a foldable or rotatable manner with respect to the proximal portion 51 along a weakened region 550, so that when the flap 5 is engaged with the flap coupling seat 500, the weakened region 550 is stowed inside the inner compartment 8.

According to further embodiment of the present invention, the gripping portion 50 is a handle that may be added later to the pizza box 1 obtained by die-cutting.

Preferably, the handle is joined to the flap 5 by bonding or constrained thereto by fastening means.

According to an advantageous variant embodiment, the pizza box 1 comprises a tray 9 housed in the inner compartment 8 in contact with the base 2. The tray is suitable for receiving the baked pizza when the pizza box 1 is in the box-like configuration S, and for being at least partially extracted from the side opening 7 when the pizza box 1 is in the laterally open configuration L.

Preferably, a weakening segment 15 is cut out on at least one of the side walls 3.

By tearing off the weakening segment 15, at least one of the side walls 3 is suitable for being removed from the pizza box 1.

A further object of the present invention is a blank suitable for producing the pizza box 1 in a single piece when properly folded.

It is well known to the person skilled in the art that the term "blank" refers to cardboard shaped by means of a die: die-cutting is the process that refers to the cutting and embossing of the sheet of cardboard to give it a particular shape.

It is therefore derivable in a totally unambiguous manner that the blank of the present invention is suitable for producing the pizza box 1 because it comprises portions of blank suitable for generating the flaps 5 equipped with the gripping portions 50 once it is folded appropriately.

Preferably, the portions of the blank have the same shape and size of the flaps 5 equipped with the gripping portions 50 of the pizza box 1.

Preferably, the blank comprises a blank plane delimited by blank edges, and the blank portions extend from two of the blank side edges.

Innovatively, the present invention fully overcomes the drawbacks of the pizza boxes of the prior art.

In fact, the present invention allows the pizza to retain heat for a longer time during the meal than pizza boxes of the prior art.

Moreover, the present invention provides the consumer with an additional way to extract the pizza, as an alternative to lifting the lid.

In particular, the presence of a flap with a gripping portion protruding externally from the front wall allows a certain pulling force to be applied to achieve disengagement of the flap 5 from the flap coupling seat 500 in an easy, convenient, and practical manner.

Advantageously, the gripping portion of the flap speeds up engagement and disengagement operations between the flap and the engagement seat, so that they may be repeated several times during the meal to repeatedly extract and reinsert the pizza or pizza slices inside the inner compartment 8.

Moreover, the present invention also facilitates folding of the front wall 3" so that it does not prevent the cutting of the pizza while it is still contained in the box, facilitating and speeding up cutting operations.

In addition, the gripping portion in the form of a corrugated cardboard tab according to a preferred variant embodiment represents a minimal modification to the existing die-cutting templates (dies) for the production of pizza boxes, and is therefore an easily industrialized solution.

A person skilled in the art may, in order to meet specific needs, make several changes to the embodiments of the present invention or substitutions of elements with other functionally equivalent ones.

These variants are also contained within the scope of protection as described and claimed herein.

What is claimed is:

1. A pizza box for containing a baked pizza, the pizza box being suitable for assuming a box-like configuration and comprising:

a base suitable for accommodating the baked pizza, said base identifying a base plane;

a lid comprising lid coupling means;

side walls having side edges in common with the base, said side walls identifying side planes incident to the base plane;

a rear wall comprising a rear edge in common with the base and a lid edge in common with the lid, said rear wall identifying a rear plane incident to the base plane;

a front wall having a front edge in common with the base, said front wall identifying a front plane incident to the base plane;

said side walls, rear wall and front wall, together with the base and the lid at least partially defining an inner compartment suitable for containing the baked pizza;

a lid coupling seat obtained on the front wall, suitable for engaging the lid coupling means;

flap coupling seats obtained on the front wall; and flaps joined to the side walls, said flaps being suitable for being removably engaged to the front wall by engagement in said flap coupling seats;

said pizza box being suitable for assuming a closed configuration in which the lid is engaged to the base by engagement between the lid coupling means and the lid coupling seat, and in which the flaps are removably engaged with respective flap coupling seats; and a laterally open configuration, in which the lid is engaged to the front wall by virtue of the engagement between the lid coupling means and the lid coupling seat, and in which at least one of the flaps is disengaged from at least one of the flap coupling seats, so that at least one of said side walls can be tilted to generate a side opening for allowing access to the inner compartment for extracting the baked pizza or a portion thereof, wherein at least one of the flaps comprises a gripping portion, and wherein, when the pizza box is in the closed configuration, said gripping portion extends outwards, on an opposite side with respect to the inner compartment, beyond the front wall of the pizza box, allowing to easily apply a pulling force to said gripping portion to disengage said at least one of the flaps from the at least one of the flap coupling seats and bring the pizza box to the laterally open configuration.

2. The pizza box of claim 1, wherein said side planes are perpendicular to the base plane.

3. The pizza box of claim 1, wherein said rear plane is perpendicular to the base plane.

4. The pizza box of claim 1, wherein said front plane is perpendicular to the base plane.

5. The pizza box of claim 1, the pizza box being suitable for assuming a totally open configuration in which the base, the side walls, the rear wall, the front wall, the lid and the flaps are all lying along the base plane.

6. The pizza box of claim 1, wherein the flaps protrude in a single piece with the side walls.

7. The pizza box of claim 1, wherein said pizza box is made of food-grade corrugated cardboard.

8. The pizza box of claim 1, wherein the gripping portion is a food-grade corrugated cardboard tab.

9. The pizza box of claim 1, wherein the flaps comprise a proximal portion having an enlarged section and wherein the gripping portion has a narrow section, such that the proximal portion makes the flaps engageable with the flap coupling seats by interference, and the gripping portion is free to move.

10. The pizza box of claim 9, wherein the gripping portion is joined to the proximal portion in a foldable or rotatable manner with respect to said proximal portion along a weakened region, such that when the flaps are engaged with the flap coupling seats, said weakened region is placed within the inner compartment.

11. The pizza box of claim 1, further comprising a tray housed in the inner compartment in contact with the base, said tray being suitable for receiving the baked pizza when the pizza box is in the box-like configuration, and for being at least partially extracted from the side opening when the pizza box is in the laterally open configuration.

12. The pizza box of claim 1, wherein at least one of the side walls comprises a weakening segment and is suitable for being removed by tearing off the weakening segment.

13. A blank for producing a pizza box according to claim 1 in a single piece.

* * * * *